United States Patent [19]

Daniel et al.

[11] Patent Number: 5,007,736

[45] Date of Patent: Apr. 16, 1991

[54] SYSTEM FOR TARGET DESIGNATION BY LASER

[75] Inventors: Jean-Pierre Daniel; Jean-Pierre Fauchard, both of Paris, France

[73] Assignee: Thomson-CSF, Paris, France

[21] Appl. No.: 22,116

[22] Filed: Feb. 14, 1979

[30] Foreign Application Priority Data

Feb. 14, 1978 [FR] France ..... 78 04092

[51] Int. Cl.[5] ..... G01B 11/26; G01C 1/00; F41G 7/00; G01N 1/20

[52] U.S. Cl. ..... 356/152; 89/41.06; 244/3.16; 250/203.2; 250/206.2; 356/141; 358/125

[58] Field of Search ..... 358/125; 356/141, 152; 89/41.06, 41.6; 244/3.16; 250/203.2, 206.2

[56] References Cited

U.S. PATENT DOCUMENTS 3,742,812 7/1973 Woodworth et al. ..... 358/125
3,743,217 7/1973 Turck ..... 244/3.16
4,024,392 5/1977 Teppo et al. ..... 244/3.16
4,160,272 7/1979 Thomas et al. ..... 358/125
4,173,414 11/1979 Vauchy et al. ..... 356/152

FOREIGN PATENT DOCUMENTS 2429006 1/1976 Fed. Rep. of Germany ..... 356/152
2625081 12/1977 Fed. Rep. of Germany ..... 356/152

*Primary Examiner*—Stephen C. Buczinski
*Attorney, Agent, or Firm*—Herbert Dubno

[57] ABSTRACT

A system for target designation by laser comprises circuitry for precise alignment of the aircraft and pod lines of sight. The alignment circuitry operates digitally in a computer in which the director cosine data of the aircraft and pod lines of sight are compared to provide error signals fed to corresponding servo-controls. Alignment is obtained by the introduction of corrective data utilized for producing vector rotations, the corrective data being produced by means of a manually controlled stick device, integration circuits and a non-volatile memory.

8 Claims, 4 Drawing Sheets

SYSTEM FOR TARGET DESIGNATION BY LASER

FIELD OF THE INVENTION

The present invention relates to an airborne system for target designation by a laser installed for the major part in a pod underneath an aircraft. The invention concerns, more especially, an alignment device with which the system is fitted.

BACKGROUND OF THE INVENTION

Systems in which a target is designated by means of a directional luminous beam provided by a laser illuminator are used for automatic tracking, fire control and television acquisition.

The first generation of airborne laser illuminator systems required two-seater aircraft with a pilot and an operator to run the system and track manually. This arrangement is incompatible with the single-seater assault and support aircraft with which the Air Force is equipped to cover tactical requirements of direct attack at low altitude and high speed.

A second generation of systems for target designation by laser followed which included automatic tracking. After target designation to a television or infrared camera associated with a tracking system, the aim of the laser beam at the target is maintained automatically without intervention by the pilot no matter how the aircraft moves. When mounted in a pod which is adaptable to several types of aircraft, the system can be used with a single-seater aircraft unlike previous systems which required an operator on board or a second aircraft for target designation by laser. The system makes possible the guidance of missiles such as passive laser autodirectors, rockets and bombs.

A laser illuminator controlled by pulse-code telemetry emits a stabilized beam kept pointed at the target by a television camera with automatic tracking. An orientation device placed at the front of the pod stabilizes the line of sight common to the television camera and the laser transmission conventionally referred to as the boresight axis. The image of the landscape is reflected by a stabilized mirror to the television camera through an optical path of variable focal length. The television image is displayed in the cockpit. The video signals are processed by the deviation-measurement circuits of the automatic-tracking system. The laser illumination is reflected by a dichroic mirror placed in the optical path so that it leaves parallel to the optical line of sight corresponding to the landscape image taken by the television camera. The stabilized mirror is used to decouple the line of sight from the virbrations of the structure and enables it to be orientated. Stabilization is produced by a yaw/pitch gyroscopic platform and orientation is provided by a rotation of the front part or head of the pod about its roll axis combined with movements of the mirror in azimuth and elevation by a universal-joint device. The television tracking system operates in two modes, the first being used to stabilize the image in the objective zone and to designate it and the second being used for automatic tracking operation. The first mode corresponds to the target acquisition or designation phase. The second mode can be produced by using the zone-correlation technique or a video contrast-analysis method. By operating in the near-infrared range, the camera provides reinforced contrast and makes possible detections and passes at ranges greater than those possible in the visible spectrum.

The target to be reached is predesignated to the television tracker by a device in the aircraft which may consist of a radar or a navigation system or a sight (helmet sight pilot collimator). Predesignation consists in slaving the pod sight direction to the aircraft target direction so that the TV image seen by the pilot includes the target.

The mechanical mounting of the pod underneath the carrier aircraft ensures parallelism of the corresponding trihedrals with limited precision. By trihedral are to be understood the conventional cartesian X, Y, Z axes. This being so, with mechanical deformations added, there is an offset between the boresight axis and the aircraft-target direction which may exceed the tolerances allowed for proper operation of the system. It is necessary to correct this by harmonizing, i.e. aligning, the sight axes by introducing elevational and azimuthal correction parameters. Doing this with an alignment device using analog processing results in an equipment which is complex and of low precision.

OBJECT OF THE INVENTION

The object of our invention is to provide a relatively simple, high-precision alignment unit which is easy to use and employs digital processing, and which allows harmonization in flight or on the ground, in the search or predesignation mode or in the automatic-tracking mode, with a precision which easily reaches a few milliradians.

SUMMARY OF THE INVENTION

In accordance with our present invention, an airborne target-designation system installed partly on an aircraft and partly on a pod carried thereon comprises target-predesignation means aboard the aircraft for generating a first set of off-aim signals representing angular deviations of a first line of sight from a first reference direction based upon the structure of the aircraft, such as one of the axes of a first cartesian trihedral as more fully described hereinafter. The system further comprises automatic acquisition equipment in the pod including a laser illuminator and a pick-up camera trained upon a common second line of sight which corresponds to the aforementioned boresight axis. The camera feeds video signals to a monitoring display aboard the aircraft for producing thereon an image of a target lying on the second line of sight, i.e. on the boresight axis, the acquisition equipment also including orientation means controlled by first servo circuitry and operatively linked with optical means in line with the camera and the illuminator for keeping the second line of sight trained upon the target in response to the first set of off-aim signals in a search mode and in response to the video signals in a tracking mode established by selector means such as a manual switch, the orientation means generating a second set of off-aim signals representing angular deviations of the second line of sight from a predetermined second reference direction which is based upon the structure of the pod and may be one of the axes of a second cartesian trihedral. To correlate the two lines of sight with each other, we provide alignment means including pilot-operated means such as a control stick aboard the aircraft for generating corrective signals upon observation of the target image from a reference point on the monitoring display, and processing means switchable by the selector means to receive the first set of off-aim signals from the target-predesignation means and to translate these signals into error signals fed to the first servo circuitry in the search mode in order to slave the second line of sight to the first line of sight, the processing means being switchable by the selector means to receive the second set of off-aim signals from the orientation means and to translate these latter signals into instruction signals fed to second servo circuitry in the target-predesignation means in the tracking mode in order to slave the first line of sight to the second line of sight. A connection extending from the pilot-operated means to the processing means supplies the corrective signals thereto, the processing means vectorially combining the received set of off-aim signals with the corrective signals to produce the error signals in the search mode and the instruction signals in the tracking mode. A non-volatile memory included in that correction stores the corrective signals and can be disconnected with the aid of switch means from the pilot-operated means upon mutual alignment of the two lines of sight whereby the corrective signals thereafter supplied to the processing means with the value required to achieve such mutual alignment are stored in the memory just before disconnection thereof from the pilot-operated means.

Advantageously, the aforementioned connection further includes integrating means inserted between the memory and the associated switch means for summing the corrective signals received during the alignment procedure. Such integrating means may derive the corrective signals from voltages appearing on a pair of sliding contacts of two potentiometers that are shiftable in two mutually orthogonal directions by a control stick constituting the pilot-operated means.

As more fully described hereinafter, each set of off-aim signals may include an azimuthal signal and an elevational signal representing respective angles of rotation about a vertical axis and a horizontal axis forming part of the associated cartesian trihedral. In that case we prefer to include in the processing means a pair of cascaded operator circuits for respectively incrementing the two angles of rotation in response to an azimuthal corrective signal and an elevational corrective signal stored in the memory. The processing means may further comprise converters for changing the received off-aim signals into cartesian input signals for the two operator circuits and for changing cartesian output signals from these operator circuit into azimuthal and elevational error and instruction signals. We also prefer to provide first conversion means between the target-predesignation means and the processing means for digitizing the first set of off-aim signals and for changing the instruction signals digitally issuing from the processing means into analog form, together with second conversion means between the processing means and the acquisition equipment for digitizing the second set of off-aim signals and changing the digitally issuing error signals into analog form.

BRIEF DESCRIPTION OF THE DRAWING

The above and other features of our invention will now be described in more detail, by way of example, with reference to the accompanying drawing in which.

SPECIFIC DESCRIPTION

Figure 1:
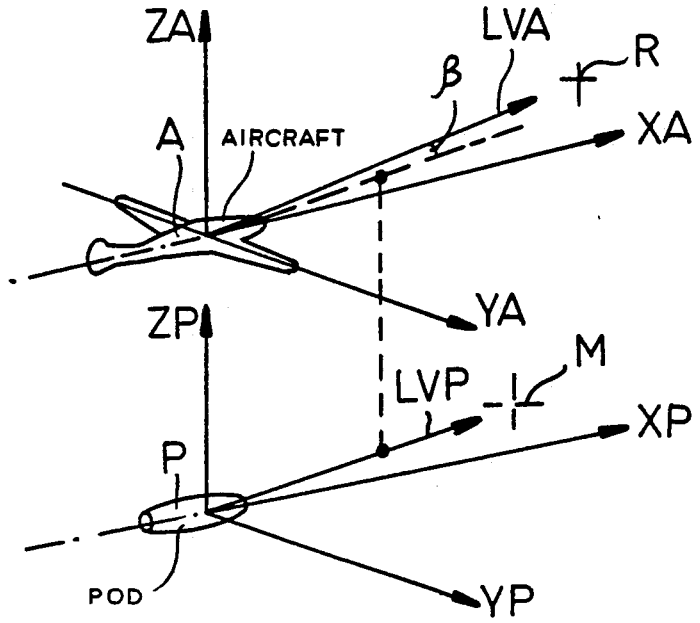
FIGS. 1, 2 and 4 are diagrams related to the problem concerned and to the alignment procedure.

The target-designation system shown in the drawing is for the most part located in a nacelle or pod P attached to a carrier aircraft A. In FIG. 1 these elements have been separated to make it easier to show their respective reference trihedrals designated by XA, YA, ZA for the aircraft A and XP, YP, ZP for the pod P. In conventional fashion, a harmonization of limited precision is obtained when the pod is installed by adjustment and locking of the mechanical fixings. A check of the verticality of the pod head, called roll harmonization, is also done. Axes XA and XP correspond to the longitudinal axes of elements A and P respectively.

The direction LVA represents the aircraft line of sight determined by a predesignation device in the aircraft. In the case of an optical sight, for example, this line is visualized for the pilot by the collimated image R of a reticle. A preliminary adjustment made on the ground enables direction LVA to be made to coincide with a longitudinal reference direction to indicate zero angular off-aim. The reference direction is related to axis XA, is close to this axis and is established by the aircraft under given conditions of horizontal flight. To simplify the explanation, axis XA will be taken as the reference direction.

Direction LVP represents the pod line of sight, i.e. the common direction of laser transmission and camera reception referred to as the boresight axis. This direction is visualized for the pilot by a test pattern M on a display monitor on board. In the same way as previously an initial adjustment of direction LVP coinciding with longitudinal axis XP corresponds to zero off-aim measured by corresponding sensor devices such as resolvers.

The angular offset $\beta$ between the sighting directions LVA and LVP results from the residual parallelism defect of the trihedrals and the residual angular deviations of the lines of sight following the adjustments previously mentioned.

The alignment unit according to our invention, more fully described hereinafter, is designed to cancel the offset $\beta$ by using digital processing in a specialized computer. The processing consists in comparing the director cosines of the lines of sight LVA and LVP by introducing corrections corresponding to vector rotations until the offset is compensated.

The alignment procedure can be carried out on the ground or in flight by using the search-operation mode or the automatic-tracking mode.

Figure 2:
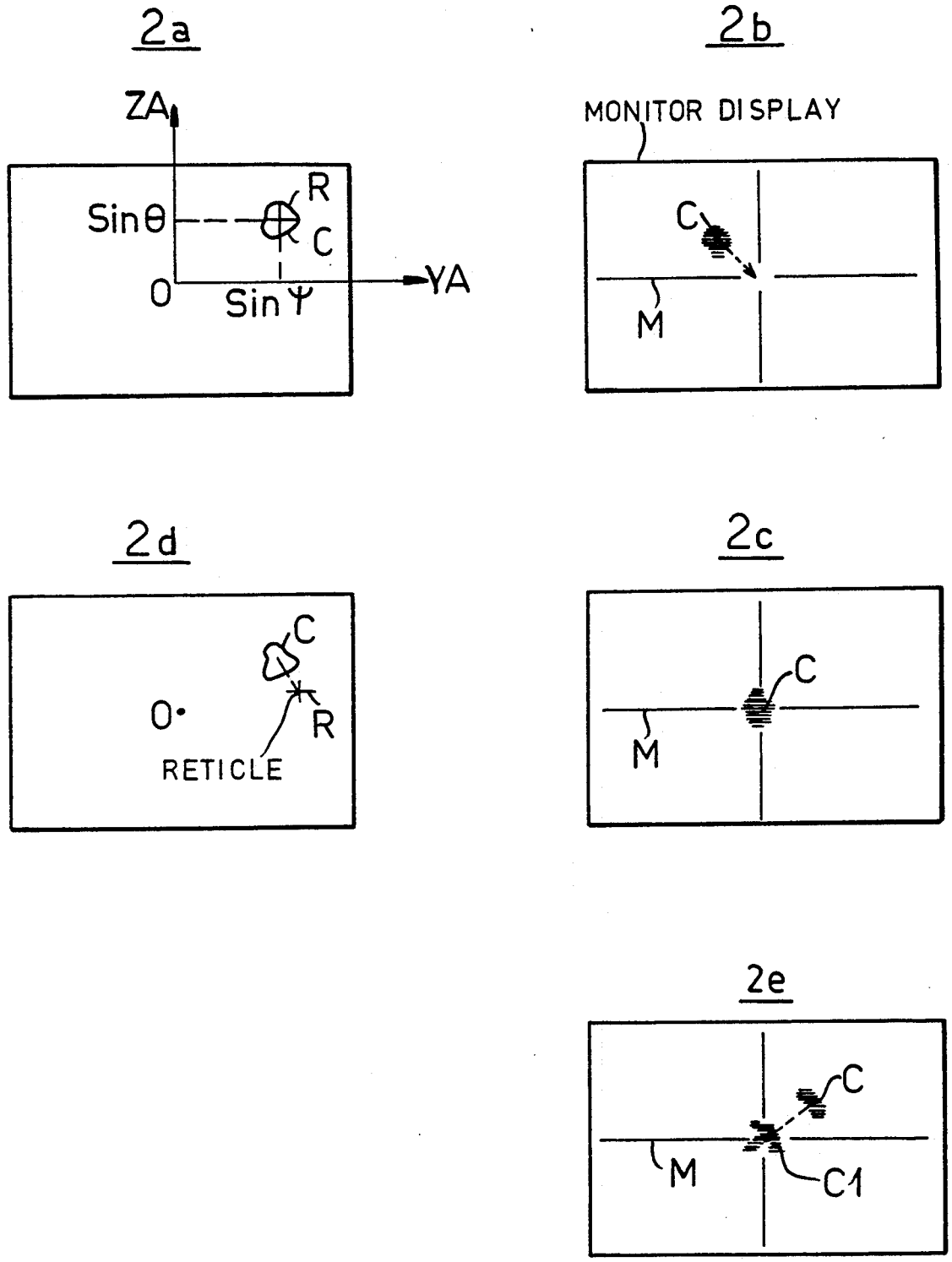

Diagrams 2*a* to 2*d* of FIG. 2 show this procedure. In the search or target-predesignation modes, the reticle R, which represents line of sight LVA, is made to coincide with a target image C, i.e. the aircraft-target line as shown in diagram 2*a*, which corresponds to a configuration of the optical sight. Because of the residual deviation mentioned, the target image C projected by the camera and seen by the pilot on the monitor may be insufficiently centered in the image displayed and may be offset from boresight axis LVP visualized by test pattern M as shown by way of example in diagram 2*b*. The operator then orders the feeding of the corrective data to cause direction LVP to be modified by means of the alignment unit until a centered image as shown in diagram 2*c* is obtained. During the predesignation phase, the boresight axis LVP is slaved to the reticle position, i.e. to the aircraft line of sight LVA. After alignment the operator can switch to the automatic-tracking mode and check that the configuration in diagram *2a* given by the sight remains unchanged. In this mode reticle R is slaved through the alignment unit to pod direction LVP.

The alignment procedure can also be carried out in the tracking mode by taking at the start a target image C sufficiently centered to allow acquisition and automatic tracking by the corresponding circuits arranged in the pod. The image on the monitor is then given by diagram *2c* and the off-aim is given at the sight level by a corresponding offset between target image C and reticle R as shown in diagram *2d*. The feeding in of corrective data by the operator enables coincidence as in diagram *2a* to be produced and alignment of axes LVA and LVP to be obtained.

After the alignment procedure the system can be used in operation with the required precision to designate a target illuminated by the laser.

An additional function is provided by the alignment unit, namely the realignment function shown in diagram *2e*. It may happen that pod line of sight LVP designates a false target C1 instead of the real target C required. This configuration is possible in particular in automatic tracking systems operating on video contrast in which the immediate surroundings of the target play a big part. The pilot is able to realize this state of affairs from the airborne display and to correct it by ordering the introduction of corrective data to train the lines of sight onto the real target C.

Figure 6:
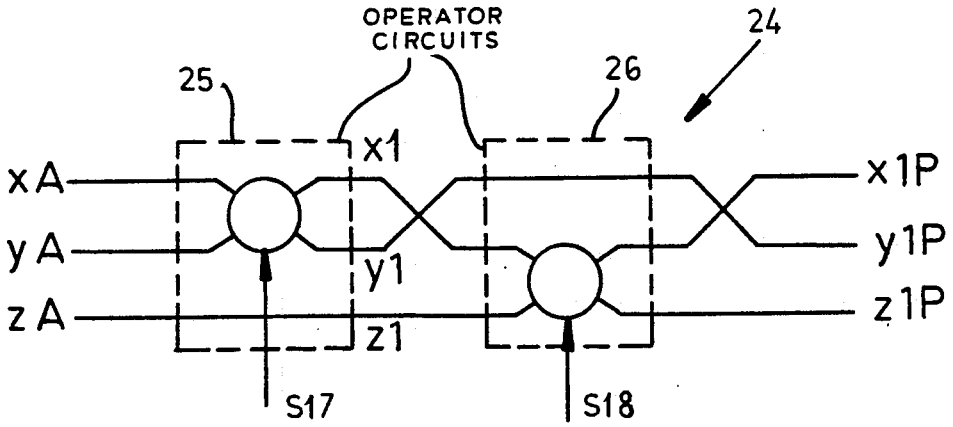
FIGS. 5 and 6 are block diagrams relating to a computer used in the alignment unit incorporated in the system of FIG. 3.

An embodiment of the alignment unit according to our invention will now be described with reference to FIGS. 3, 5 and 6.

Figure 3:
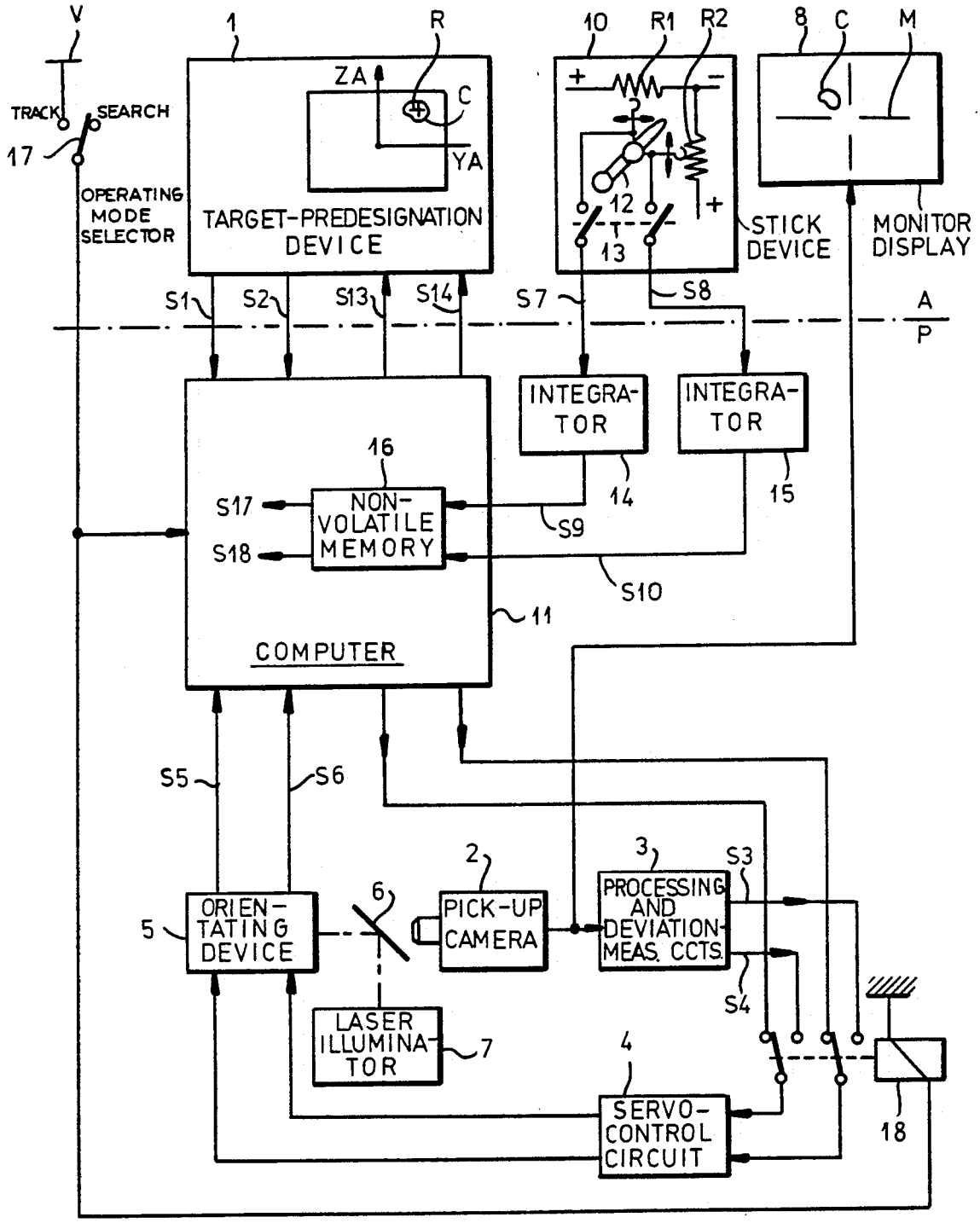
FIG. 3 is a simplified block diagram of a system for target designation by laser, including an alignment unit according to our invention.

In FIG. 3, the essential elements of the target-designation system are represented with their situation in aircraft part A and pod part P distinguished by their positions above and below a heavy dashed line. A predesignation device 1 produces signals representing the angular offset $\alpha$ (FIG. 4) between line of sight LVA and reference direction XA, i.e. the off-aim of the target after alignment thereof with the marker R. Assume, for example, that a piloting collimator delivers two signals S1 and S2 representing the elevation and azimuth parameters of reticle R designated by the angles $\theta$ and $\psi$, respectively, in FIG. 4. Signals S1 and S2 correspond to coordinates yA and zA of the reticle, i.e. to sin $\psi$ and sin $\theta$ (diagram *2a*). It is to be assumed that the aircraft and sight reference trihedrals were previously harmonized by a conventional adjustment carried out when the sight was installed on board.

In pod P, a pick-up camera 2, e.g. a television or infrared camera, feeds an electronic processing and deviation-measurement assembly 3 which delivers signals representing the target angular off-aim with respect to direction LVP in the tracking mode. The signals may consist of two target-elevation and target-azimuth error signals S3 and S4. They feed associated servo circuits 4 to control the orientation and to stabilize the boresight axis LVP aimed at the predesignated target. An electromechanical device 5, which is controlled by servo circuits 4, includes an assembly with a universal joint for orientation in elevation and azimuth of optical means, specifically a mirror, along the two corresponding axes and synchro devices, e.g. resolvers, to produce signals S5 and S6 representing the elevation and azimuth of direction LVP with respect to the pod trihedral. A dichroic mirror 6, inserted in the optical path, enables the transmission of a laser beam from an illuminator 7 in a direction common to that of reception by camera 2.

The video signal delivered by camera 2 is applied in the aircraft to a display monitor 8 for observation of the corresponding image by the pilot.

The alignment unit comprises a control device 10 in the aircraft and a specialized computer 11 in the pod. Control device 10 enables corrective data to be produced. It advantageously includes a control stick 12 operated by the pilot in two mutually orthogonal directions, right to left and front to rear, and two potentiometers R1 and R2 whose sliding contacts are fixed to the stick. In the central position, at rest, signals S7 and S8 delivered by the sliding contacts in the form of voltages are zero. When the stick is moved, the amplitude of these signals is a function of the sliding-contact movement and their sign is a function of the direction of movement, right or left, front or rear, from the rest position. Correction signals S7 and S8 are transmitted, through a switch 13 which can be closed by the pilot, to respective integrating circuits 14 and 15 which may be located in the pod. The respective outputs S9 and S10 represent the sum of the various corrections resulting from the different movements of the control stick by the pilot. The integrated values are transmitted to the specialized computer 11 where they are stored in a non-volatile memory 16 which retains the data when the power supply is cut off by the opening of switch 12 after the two lines of sight LVP and LVA have been correlated by the alignment unit.

Movements of control stick 12 from right to left (or vice versa) change the position of the sliding contact in potentiometer R1 and generate signals S7 to correct the azimuth reading. In the same way, movements from front to rear (or vice versa) displace the sliding contact of potentiometer R2 and generate signals S8 for correcting the elevation. The values produced in succession are summed in circuits 14 and 15, respectively, until the values $\psi 1$ and $\theta 1$, which are required for coincidence of the sight axes, are obtained through the servo-control loop (target image C coinciding with reticle R and the center of test pattern M).

Computer 11, responding to sight signals S1 and S2, signals S5 and S6 of orientation device 5 and integrated correction signals S9 and S10, emits alignment instructions in the form of error signals S11 and S12, which are fed to servo-controls 4 designed to slave boresight axis LVP to reticle R when operating in the search mode. In the tracking mode the computer produces instruction signals S13 and S14 which are fed to ancillary servo-control circuits 30 (FIG. 5) in predesignation device 1 adapted to slave the aircraft line of sight LVA to pod line LVP. The pilot has available a selector switch 17 to establish the search or the tracking mode and to control corresponding switching devices in the computing circuits of the pod along with a relay 18 having switchover contacts in the input of servo-control circuit 4.

Figure 4:
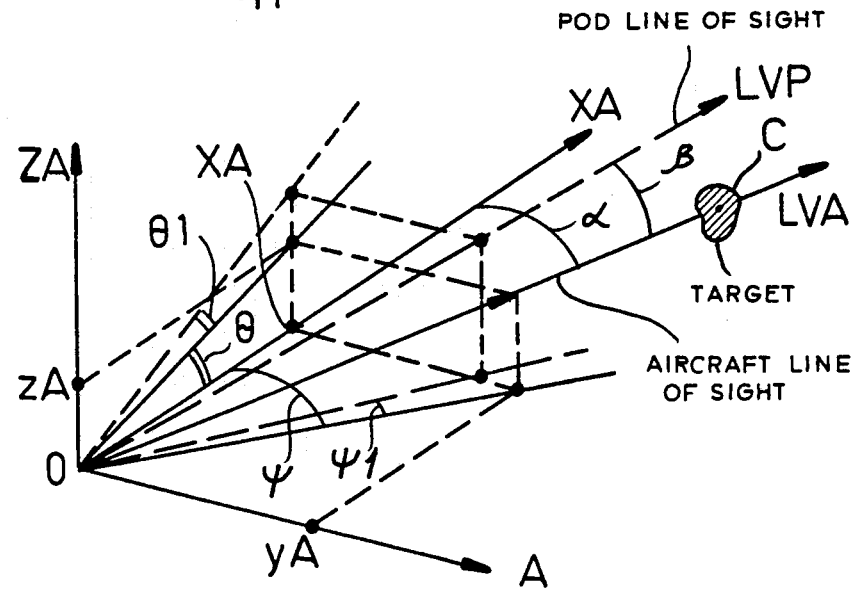
Figure 5:
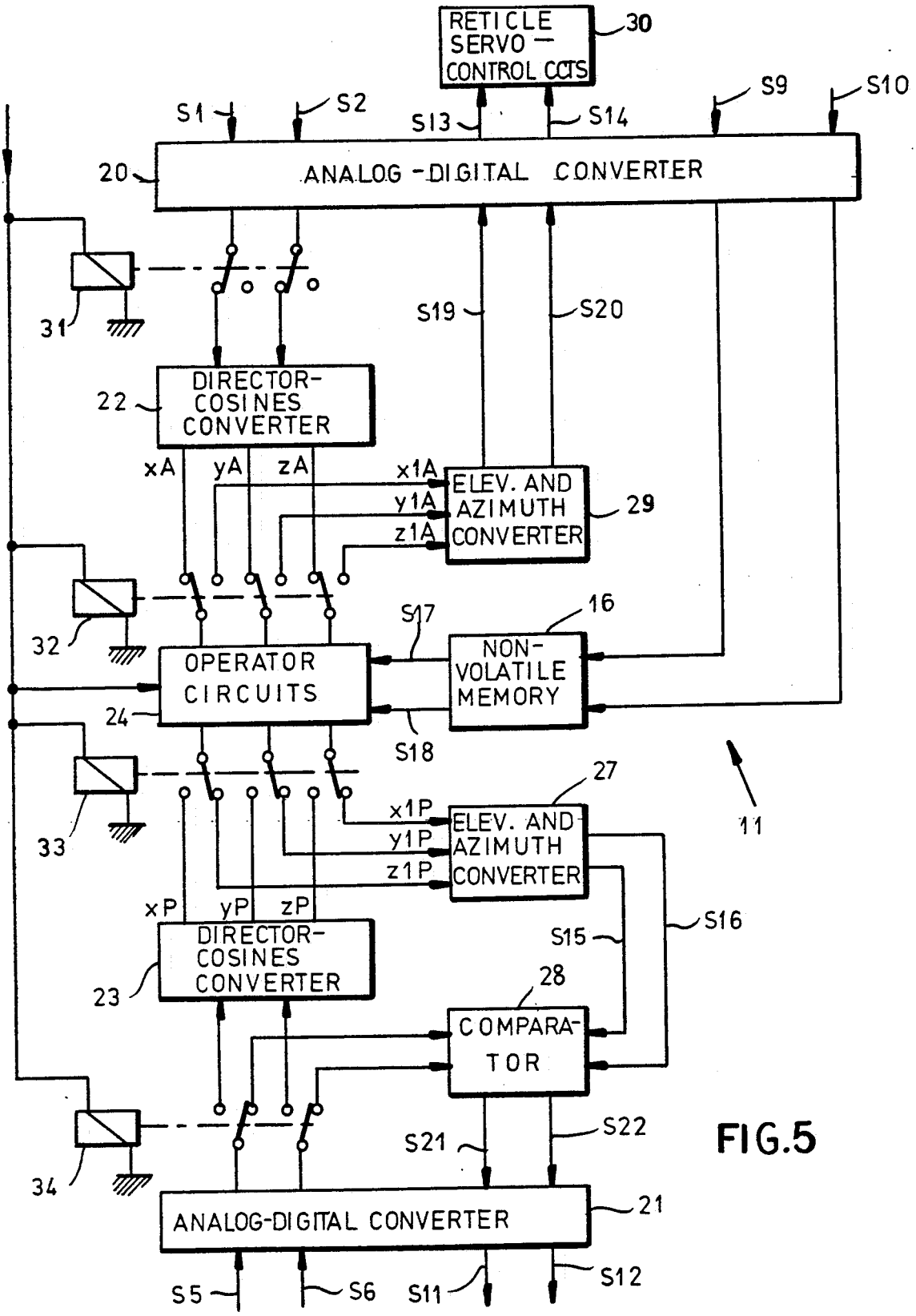

FIG. 5 shows a functional diagram of computer 11. It is to be understood that the practical design of the computer may be different and be based on conventional structures with memory, programmer, arithmetic unit, addressing circuitry, etc. Circuits 20 and 21 perform an analog-digital conversion of incident signals S1, S2, S5, S6, S9 and S10 and an opposite conversion for the emitted alignment signals S11 to S14. Circuits 22 and 23 convert the incident signals into signals representing the director cosines of the line of sight in the corresponding trihedral. From signals S1 and S2, in the search mode, circuit 22 derives coordinates xA, yA and zA corresponding to the components of the unit vector along line of sight LVA (FIG. 4). These coordinates are related to angular deviations $\psi$ and $\theta$ by:

$$xA = \frac{yA}{\tan\psi} = \frac{zA}{\tan\theta} = \frac{\cos\psi}{\sqrt{1 + \tan^2\theta \cos^2\psi}} = \frac{\cos\theta}{\sqrt{1 + \tan^2\psi \cos^2\theta}}$$

and to one another by:

$$x^2A + y^2A + z^2A = 1.$$

Circuit 23 analogously derives, in the tracking mode, coordinates xP, yP, 2P for the boresight unit vector from signals S5 and S6.

Data S17 and S18 stored in non-volatile memory 16, upon successive manual movements of control stick 12, correspond after alignment to the final angular corrections $\psi 1$ and $\theta 1$. A processor component 24 produces the corrective vector rotations required; its external corrections shown in FIG. 5 are for operation in the search mode. FIG. 6 depicts component 24 as comprising two cascaded circuits 25 and 26.

Circuit 25 yields a first-stage transformation:

$xl = xA \cos \Delta\psi + yA \sin \Delta\psi$ $yl = -xA \sin \Delta\psi + yA \cos \Delta\psi$ $zl = zA$ (unchanged)

which corresponds to a rotation by an angular increment around $\Delta\psi$ axis ZA, the value $\Delta\psi$ being represented by signal S17 at the instant considered. In the same way, circuit 26 yields a second-stage transformation:

$xlP = xl \cos \Delta\theta - zl \sin \Delta\theta$ $ylP = yl$ (unchanged)

$zlP = xl \sin \Delta\theta + zl \cos \Delta\theta$ which corresponds to a rotation by an angular increment $\Delta\theta$ around axis YA, the value $\Delta\theta$ being represented by signal S18 at the instant considered. Coordinates xlP, ylP and zlP are compared with those furnished by boresight axis LVP to give, after data conversion, analog error signals S11 and S12. The comparison can be made with signals xP, yP and zP, resulting from the conversion of signals S5 and S6 in circuit 21 followed by a conversion in circuit 23 (FIG. 5), to provide elevational and azimuthal error signals, or, as shown, by a preliminary conversion of the aforementioned coordinates in a circuit 27 into two signals S15 and S16 which are then compared with the digitized orientation signals S5, S6 in a circuit 28. A resulting error signal S21 corresponds to the difference between signals S15 and S5 while another error signal S22 represents the difference between signals S16 and S6. Upon achievement of alignment, i.e. when the target image C has been centered on test pattern M, stored data S17 and S18 represent the instruction values which ensure automatic alignment of the aircraft and pod sight axes when the equipment is switched on. A circuit 29 similar to circuit 27 is used in the tracking mode when the mode selector 17 (FIG. 3) is reversed. Selector 17 also controls relays 31 to 34 which enable the connections to be changed according to whether the tracking or the search mode is used. The instruction data S19 and S20 delivered by circuit 29 in the tracking mode are converted in circuit 20 into analog signals S13 and are S14 and transmitted to the circuits 30 in the predesignation device 1 (FIG. 3) to be processed there and to provide servo-control of the reticle when the pod line of sight is read. Circuits 30 are designed in accordance with known techniques in keeping with the type of predesignation device used in the system.

The circuitry shown in FIG. 5 may be located in part aboard the aircraft, in particular converter circuits 20 and 22. Thus, the signals transmitted through an aircraft-pod interface circuit are digital. Predesignation device 1, in the case of a radar for example, can supply signals xA, yA and zA directly.

Also, it may be noted that the processing and deviation-measurement circuits 3 may contain a computer which may be used with appropriate programming to carry out the successive operations performed by the computer 11 of FIG. 5. In such a case the alignment unit is virtually reduced to elements 10, 14, 15 and 16, the other circuits of specialized computer 11 being included in the deviation-measurement computer.

In the system described no allowance has been made for a roll-harmonizing error compensation since in practice a check of the initial pod-head verticality can be made mechanically with sufficient precision for this additional parameter to be disregarded. The verticality check consists in bringing the plane zP, xP to ground along the aircraft vertical line ZA. However, if it is desired to allow for this parameter, corresponding signals must be supplied by a vertical-control center in the aircraft and a sensor in the pod and computer 11, with circuits 24 modified to introduce the rotation of a complementary vector.

The target-designation system described can be used in particular for air-to-ground fire control.

What is claimed is:

1. An airborne target-designation system installed partly on an aircraft and partly on a pod carried by said aircraft, comprising:

target-predesignation means aboard the aircraft for generating a first set of off-aim signals representing angular deviations of a first line of sight from a first reference direction based upon the structure of the aircraft;

monitoring display means aboard the aircraft;

automatic acquisition equipment in the pod including a laser illuminator and a pick-up camera trained upon a common second line of sight, said camera feeding video signals to said display means for producing thereon an image of a target lying on said second line of sight, said equipment further including orientation means controlled by first servo circuitry and operatively linked with optical means in line with said camera and said illuminator for keeping said second line of sight trained upon the target in response to said first set of off-aim signals in a search mode and in response to said video signals in a tracking mode, said orientation means generating a second set of off-aim signals representing angular deviations of said second line of sight from a predetermined second reference direction based upon the structure of the pod;

selector means for establishing either one of said modes; and alignment means for correlating said lines of sight with each other, said alignment means including pilot-operated means aboard the aircraft for generating corrective signals upon observation of an offset of the target image from a reference point on said monitoring means, processing means switchable by said selector means to receive said first set of off-aim signals from said target-predesignation means and to translate same into error signals fed to said first servo circuitry in said search mode to slave said second line of sight to said first line of sight, said processing means being switchable by said selector means to receive said second set of off-aim signals from said orientation means and to translate same into instruction signals fed to second servo circuitry in said target-predesignation means in said tracking mode to slave said first line of sight to said second line of sight, and a connection extending from said pilot-operated means to said processing means for supplying said corrective signals thereto, said processing means vectorially combining the received set of off-aim signals with said corrective signals to produce said error signals in said search mode and said instruction signals in said tracking mode, said connection including a non-volatile memory for storing said corrective signals and switch means operable to disconnect said memory from said pilot-operated means upon mutual alignment of said lines of sight whereby the corrective signals thereafter supplied to said processing means have the value required to achieve said mutual alignment.

2. A system as defined in claim 1 wherein said connection further includes integrating means inserted between said switch means and said memory for summing said corrective signals.

3. A system as defined in claim 2 wherein said pilot-operated means comprises a control stick movable in two mutually orthogonal directions, a first potentiometer with a sliding contact shiftable by said stick upon movement thereof in one of said orthogonal directions, and a second potentiometer with a sliding contact shiftable by said stick upon movement thereof in the other of said orthogonal directions, said corrective signals being derived by said integrating means from voltages appearing on said sliding contacts.

4. A system as defined in claim 3 wherein said connection further includes an analog-digital converter inserted between said integrating means and said memory.

5. A system as defined in claims 1, 2, 3 or 4 wherein each set of off-aim signals includes an azimuthal signal and an elevational signal representing respective angles of rotation about a vertical axis and a horizontal axis forming part of a cartesian trihedral associated with the corresponding reference direction, said processing means comprising two cascaded operator circuits for respectively incrementing said angles of rotation in response to an azimuthal corrective signal and an elevational corrective signal stored in said memory.

6. A system as defined in claim 5 wherein said processing means further comprises converters for changing the received off-aim signals into cartesian input signals for said operator circuits and for changing cartesian output signals from said operator circuits into azimuthal and elevational error and instruction signals.

7. A system as defined in claim 5 wherein said processing means further comprises a comparator connected in said search mode to receive said second set of off-aim signals from said orientation means together with output signals from said operator circuits to derive said error signals therefrom.

8. A system as defined in claims 1, 2 or 3, further comprising first conversion means between said target-predesignation means and said processing means for digitizing said first set of off-aim signals and second conversion means between said equipment and said processing means for digitizing said second set of off-aim signals, said instruction signals and said error signals issuing from said processing means in digital form and being changed into analog form by said first and second conversion means, respectively.

* * * * *